United States Patent [19]

Dejanovich

[11] Patent Number: 4,473,014

[45] Date of Patent: Sep. 25, 1984

[54] CYCLONE DETECTOR

[75] Inventor: Daniel Dejanovich, Libertyville, Ill.

[73] Assignee: Commonwealth Edison Company, Chicago, Ill.

[21] Appl. No.: 427,918

[22] Filed: Sep. 29, 1982

[51] Int. Cl.[3] ..... F23D 1/02

[52] U.S. Cl. ..... 110/264; 431/158

[58] Field of Search ..... 110/264, 265; 431/158

[56] References Cited

U.S. PATENT DOCUMENTS 3,124,086 3/1964 Sage et al. ..... 110/264

*Primary Examiner*—Edward G. Favors

*Attorney, Agent, or Firm*—Emrich & Dithmar

[57] ABSTRACT

A cyclone furnace assembly includes a housing having an inlet end and an outlet end, with the inlet end cooperating with a fuel inlet chamber which injects the ash-containing fuel-air mixture into the furnace. The outlet end of the furnace includes a re-entrant throat extension member having an outer surface which is flared towards the frontal inlet wall surface of the furnace housing for increasing the residence time of the fuel-air mixture within the assembly to insure combustion of the fuel-air mixture.

5 Claims, 5 Drawing Figures

CYCLONE DETECTOR

BACKGROUND OF THE INVENTION

The present invention relates to a novel cyclone firing apparatus and to a novel method of burning ash-containing solid fuels and, in particular, to an apparatus and a method of burning lower rank coals having a high moisture content and a relatively low BTU reading, such as subbituminous class coals.

At present the most acceptable method utilized for firing coal for boilers, such as used in the electric utility industry, is that of the "cyclone" furnace. The cyclone furnace designed to burn ash-containing fuels was first introduced by U.S. Pat. No. 2,357,301. The cyclone furnace is primarily designed to utilize bituminous coals having a relatively high heat rating and low moisture content. The method and apparatus of the cyclone furnace has been further improved in subsequent patents, for example, U.S. Pat. Nos. 2,717,563, 2,731,955, 2,800,091 and 3,039,406.

In the original and succeeding patents listed above, which relate to the cyclonic principle of burning ash-containing fuels, the exit for the hot gases from the burned coal takes the shape of a cylinder or cone which protrudes part way into the combusion section or chamber of the furnace. This opening, which is known as the re-entry throat, is located at the rear of the cyclone furnace, opposite the end where the coal enters the furnace.

The above-identified prior art patents disclose a furnace structure which permits the unburned coal particles traveling along the walls of the interior of the furnace chamber away from the point of entry toward the rear of the cyclone furnace to be re-directed by the re-entry throat towards the center axis of the furnace where the hot gases therein force the carbon particles out of the furnace before they have sufficient time to completely oxidize and form ash particles which stick to the furnace walls and become part of the melted slag mass. The re-entry throat structures of the prior art patents are designed so that their outer surface flares or is directed toward the exit end of the furnace chamber.

The succeeding patents, such as U.S. Pat. Nos. 2,717,563, 2,731,955, 2,800,091 and 3,039,406, recognize several major problems which exist with the usage of such cyclone furnace structures. These problems are the incomplete combustion resulting in unburned carbon leaving the furnace chamber, an accumulation of slag in the bottom of the furnace chamber which destroys the cyclonic effect within the furnace thus compounding the slag build-up and resulting in plugging of the slag hole and excessive carry over ash and unburned coal thereby substantially destroying the effectiveness of the cyclone furnace.

These problems are accentuated by the burning of coals which have lower heat content, higher moisture and higher ash temperatures, such as are found in the Western part of the United States. For example, cyclone furnaces have been operated successfully since the late 1940's through the 1960's utilizing Illinois coal having a heat content of approximately 10,500 BTU's per pound, with a moisture content of about 12.2% and a fusion temperature of approximately 2,100° F. However, when low sulfer Western coal, such as from Montana or Wyoming, having a heat content of approximately 9,300 BTU's per pound, a moisture content of approximately 24% and an ash fusion temperature of 2,400°–2,700° F. are fired in cyclone furnaces, because of environmental reasons, the results and burning thereof are extremely unsatisfactory.

For example, the lower BTU content of Western coal for a given fuel mass input results in the achievement of reduced combustion temperatures within the cyclone furnace. Additionally, the higher moisture content of Western coal results also in a slower burning rate and a reduced combustion temperature because a portion of the heat within the furnace is required to evaporate the moisture from the coal. This slower burning rate and further reduced combustion temperature are the major causes of improper slag formation and flow and carbon carryover. That is, unburned carbon exits the cyclone furnace to accumulate in the air heat and precipitator hoppers. Fires may result from this carbon carryover causing severe damage to the precipitators, fabric filters or air heaters. Also, the operating and maintenance costs increase significantly because much of the fuel is unburned and the amount of ash for disposal is substantially increased.

The higher ash fusion temperature of Western coals results in cyclone furnace slag tap plugging because the ash fluid temperature is not obtained and the lower combustion temperatures caused by the lower BTU high moisture content aggravate the slagging problem.

Specifically, the lack of complete combustion of Western coal particles in the cyclone furnace results in unburned carbon particles, leaving the cyclone, impinging upon the steel tubes in the adjacent boiler, thereby causing errosion damage and subsequent failure of the boiler. The unburned coal particles, leaving the cyclone chamber, are not converted to slag inside the furnace, therefore, they must be removed by external precipitators and fabric filters. When the carbon in these coal particles is not completely oxidized by the time they reach the precipitators or fabric bag filters, further damage in the form of fires may result at the precipitators or fabric bag filters.

Additionally, because a significant percentage of the heat content of the Western coal particles is not released inside the cyclone furnace chamber, a temperature sufficient to keep the viscosity of the slag at a point where it will flow into slag tap under the re-entry cone cannot be maintained. This condition is accentuated with the decreasing heat content and increasing moisture content of Western coals. When the slag tap becomes plugged, the slag accumulates in the bottom of the cyclone furnace chamber and the cyclonic action is destroyed and the slag and ash must either accumulate in the cyclone furnace chamber or exit through the re-entry cone, thus compounding the problems of operation. Accordingly, the present cyclone furnace structures in operation have a narrow tolerance of acceptable fuels and operating conditions of fuel-air ratios, which have severely restricted their commercialization.

SUMMARY OF THE INVENTION

It is an object of the present invention to provide a cyclonic type furnace chamber whereby the average residence time of fuel particles is increased and more complete combustion of the particles is accomplished inside the cyclone furnace chamber thus maximizing conversion of solid fuel to gaseous products while inside the furnace chamber.

It is another object of the present invention to provide a cyclonic type furnace having a wide tolerance of ash-containing fuels for satisfactory combustion within the furnace.

It is still another object of the present invention to provide a cyclonic type furnace whereby the amount of ash particles resulting from the combustion of the fuel particles leaving the cyclone furnace is minimized and substantially eliminated.

It is a further object of the present invention to constantly provide a sufficiently high temperature inside the cyclone furnace chamber and, in particular, in the vicinity of the slag tap opening to maintain the viscosity of the resulting slag above that required for its flowing to and through the slag tap opening, thus maintaining proper operation of the cyclonic action within the furnace chamber.

Briefly, the novel deflector cyclone furnace in accordance with one embodiment of the present invention is useful as a furnace chamber for reliably and economically conbusting a wide variety of ash-containing fuels for maximizing the non-combustible solids being carried out through the re-entry opening, and for maintaining a continuous flow of molten slag through the slag tap opening.

The novel deflector cyclone furnace chamber is similar in construction to prior cyclone furnace designs in practical use throughout the world for over 30 years with one very important difference in the design of the re-entry throat. In fact, all of the prior cyclone furnaces now installed may be readily modified in situ to take advantage of the enhanced combustion characteristics of the present invention.

More specifically, the present invention is characterized by a conventional cyclone furnace housing positioned with its main axis in a substantially horizontal position, with its fuel inlet at one end and the re-entry cone and slag outlet at the opposite end. The fuel inlet system may be any of the common methods known as Vortex burners, Scroll burners, or Radial burners, as is well known in the art.

The specific feature of the present invention is the novel design of the re-entry throat. Where all other cyclone furnace chambers have re-entrant throats designed to deflect the products of combustion back into the furnace toward the main central axis of the furnace, the present invention incorporates a re-entrant throat designed to deflect the flow away from the main central axis, and toward the cylindrical walls at the forward end of the furnace, thereby increasing the recycling time of the larger fuel particles within the furnace chamber which have not been completely oxidized. This results in an increased oxidizing burning residence time within the furnace chamber wiich provides the unexpected results of the present invention.

Actual firing tests on the present invention have been made utilizing existing cyclone furnaces at two different electric generating stations by adding an extension member on to the re-entry throat, thus modifying the length and overall shape of the re-entry throat. The test extension member was fabricated of steel tubes after which steel studs were welded to the outer surfaces thereof for purposes of increasing heat transfer similar to the construction of the main cyclone furnace chamber walls. Because these initial installations were for the purpose of tests and no consideration was given that these test installations would remain permanent, a separate cooling water supply was provided to the deflector cone or extension member. One cyclone furnace of a 5-cyclone boiler powering a steam turbine generator unit having a rating of 160 megawatts was modified in accordance with the present invention. A Western coal crushed and sized to pass a minimum of 95% through a #4 screen was utilized for the test. All five cyclones were fired and each observed for operating characteristics, particularly the slagging properties and tendency to plug the slag tap opening.

Additionally, two cyclone furnaces of a 4-cyclone boiler powering a 120 megawatt steam turbine generator were modified to accept the present invention, while the remaining two were left as originally designed. A Western coal designated as Arch Mineral was crushed and sized to pass a minimum of 95% through a #4 screen was utilized for the test. All four cyclones were fired and each observed for burning characteristics, particularly the slagging properties and tendency to plug the slag tap opening.

In both test conditions, the cyclone furnaces having the modified re-entrant throat of the present invention exhibited superior characteristics in the slag coating of the furnace walls and maintaining a free flow of slag through the slag tap opening.

DETAILED DESCRIPTION OF THE INVENTION

Figure 1:
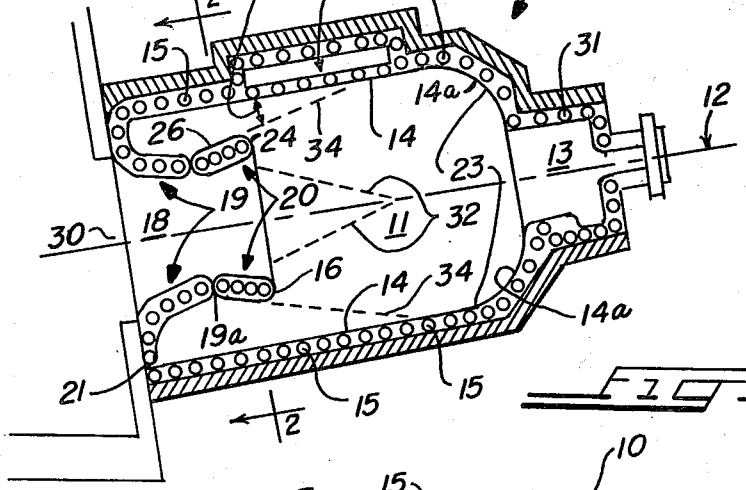
FIG. 1 is a sectional view of a cyclone furnace chamber in accordance with one embodiment of the present invention.

Referring now to the drawings wherein like reference numerals have been used throughout the several views to designate the same or similar parts, in FIG. 1 there is shown a sectional view of a cyclone furnace structure or assembly 10 which includes a main or primary furnace chamber 11 having a substantially cylindrical configuration with a fuel-air inlet opening 13 having a smaller cylindrical formation at the forward end 31 concentric with the larger main furnace chamber 11. The fuel-air inlet opening chamber 13 may be one of many typical designs such as is known to those familiar with the state of the art as the Vortex burner, the Scroll burner, or Radial burner. Each of these designs possess the same general function and characteristic of creating a cyclonic action of fuel and air within the main furnace chamber 11 as crushed solid fuel and air are injected tangentially into the fuel inlet opening chamber 13 and ignited in the forward portion of the main furnace chamber 11. The cyclonic action of the burning fuel and air within the chamber 11 continues to progress in a helical path therein with the coal particles scrubbing the furnace walls 14, leaving the walls covered with a molten coating of slag.

Water cooling tubes 15 are positioned about the chamber 11 to maintain the furnace 10 within the operating temperature ranges, with the cooling tubes 15 covered by a layer of refractory material 23 which defines the walls 14 and boundary of the furnace chambers 11, 13. Generally, the surface of the furnace walls 14 include metallic studs thereon to aid in heat transmission. The mechanics of cyclone furnace construction and operation are well known to those skilled in the art and is further explained in the forementioned United States patents and in the reference book *Steam,* Chapter 10, 38th Edition, published by the Babcock & Wilcox Company, hereby included as reference.

The cyclonic action of the fuel-air mixture within the chamber 11 is enhanced by the introduction of secondary source of air from ports 17 which extends along approximately half of the roof of the main furnace chamber 11. This secondary air source 17 is introduced in the same direction of rotation as the primary air-fuel streams within the chamber, and is controllable by dampers and deflectors, not shown.

Figure 2:
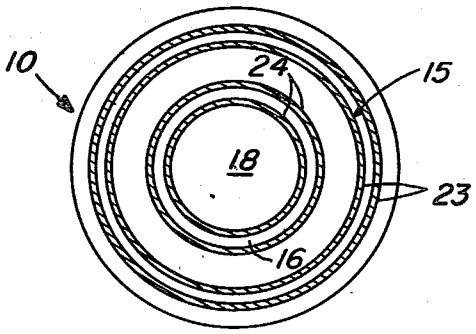
FIG. 2 is a view taken along line 2—2 of FIG. 1.

Referring now to FIG. 2 in addition to FIG. 1, the rear end 30 (FIG. 1) of the furnace chamber 11 is provided with a gas outlet 18, generally integrally formed (FIG. 1) by a re-entrant throat 19, which is of a construction similar to that of the furnace chamber walls 14, and which utilize steel water tubes 15 having steel studs welded to the surface for heat transmission. The re-entrant throat 19 is covered also with a suitable refractory material 23 such as a high temperature plastic refractory, the same material which is used to cover the water tubes 15 of the furnace walls 14. The re-entrant throat 19 is shaped in such a manner that the unburned coal particles which have escaped capture by the molten slag on the furnace wall 14 during the initial pass through the furnace chamber 11 are re-directed back toward the central axis 12 of the furnace 10, as shown by the dotted lines 32 in FIG. 1.

Existing furnace chamber constructions which redirect the particles toward the central axis 12 of the furnace results in the hot gases within the chamber 11 forcing the unburned coal particles out of the gas outlet 18 before the particles have sufficient time to completely oxidize. This incomplete oxidation further increases slag formation which results in increased slag build up which destroys the cyclonic effect within the furnace chamber 11.

Figure 3:
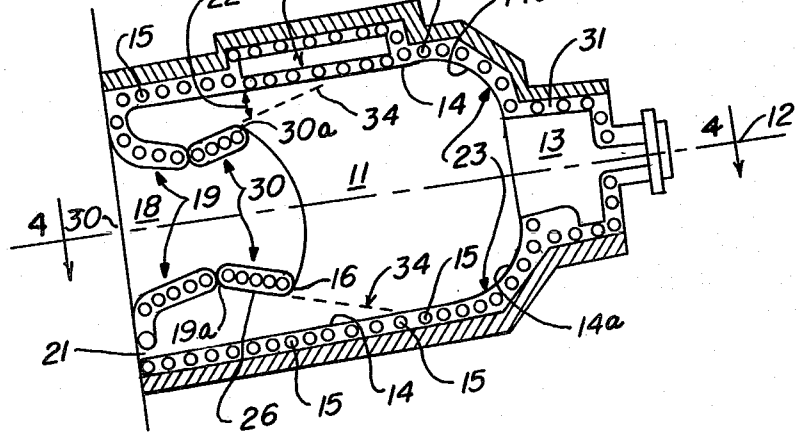
FIG. 3 is a sectional view of a cyclone furnace chamber in accordance with a further embodiment of the present invention.
Figure 5:
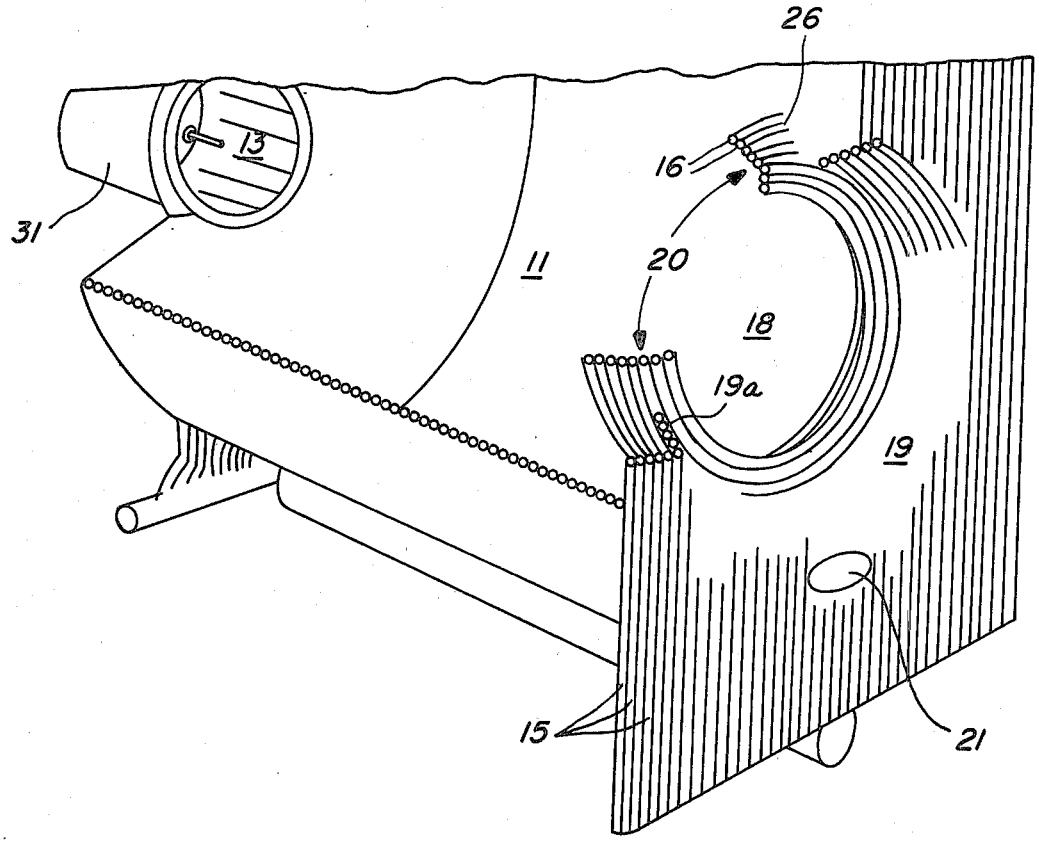
FIG. 5 is a partial perspective view of the throat extension member mounted in a cyclone furnace in accordance with the present invention.

It has been found that the utilization of a frustoconical shaped extension member 20, best shown in FIGS. 1 and 5, is welded to the end 19*a* of the re-entrant throat or element 19 to provide an extension to the re-entrant throat 19 and to provide redirection of the unburned coal particles-air mixture toward the surface walls 14 of the chamber 11, as shown by the dotted lines 34 in FIGS. 1 and 3. Preferably, it has been found that the redirection of the unburned coal particles-air mixture provide optimum results when the coal particles are directed toward the frontal corner surface 14*a,* as shown in FIGS. 1 and 3.

Unexpectedly, the utilization of a re-entrant throat extension member 20 positioned upon the end of 19*a* of a re-entrant throat 19 appears to increase and maintain the temperature of the area about the slag tap opening 21, in the bottom of the furnace chamber 11, well above the ash fusion point so that slag flows through the opening 21 without plugging, thereby effectively increasing the operating conditions and times for a furnace 10. This increased operating condition and times for the furnace 10 results when a Western type coal having a wide top variation of ash and moisture contents, is oxidized and results in maintaining the resulting slag at a viscosity above that required to permit the slag to flow through the slag tap opening.

As shown in FIG. 5, the frustoconical shaped re-entrant throat extension member 20 is comprised of a coil of steel tubes structured in such a manner to provide a frustoconical structure 20. The steel cooling tubes 16 include metallic studs thereon covered by a layer of refractory material 24 thereon which defines the outer surface wall 26 of the extension member 20. Generally, the cooling water may be fed to the re-entrant throat extension member 20 from the same source that supplies the cooling tubes 15 in the furnace chamber walls 14. In many instances an existing cyclone furnace 10 may be altered to conform to the design and shape in accordance with the present invention. This may be accomplished by adding the throat extension member 20 to an existing gas outlet throat 19 to form the re-entrant throat assembly 19, 20, as shown in FIGS. 1 and 3.

The angles 22 formed by the deflection of particles by the re-entrant throat member 20 within the furnace against the wall surface 14 of the chamber 11, shown by dotted lines 34 (FIGS. 1 and 3), is such that an extension of the outer surface 24 of the throat member 20 is directed toward the forward portion of the wall surface 14 of the furnace chamber 11. For one design of a cyclone furnace having an inner diameter of 9 feet and an overall length of 12 feet, this angle is approximately about 15°. The overall length of the extension throat member 20 in this embodiment of a cyclone furnace having the dimensions given above is 13 inches, which translates into about 144 feet of $1\frac{1}{4}$ inch steel tubes to form the frustoconical throat extension member 20. However, it is only sufficient that the extension throat member 20 deflect the fuel-air particles toward the forward portion of the furnace chamber 11 to increase the oxidation or combustion time of the particles within the chamber.

Figure 4:
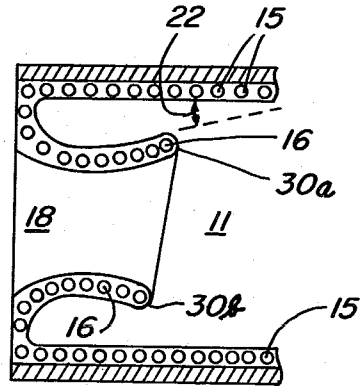
FIG. 4 is an enlarged sectional view of a re-entrydeflection end of a cyclone furnace chamber in accordance with the present invention.

In a further embodiment of the present invention, FIGS. 3 and 4 disclose a non-symmetrical design of a throat extension member 30. This particular throat extension member 30 is designed to compensate for the added distance of the heat-air travel of the air fuel mixture within the chamber 11, from the secondary air port 17. In this embodiment of the present invention, one-half of the throat extension member 30, which is immediately behind or to the lee side 30*a* of the secondary air port 17, is longer by width by one or two water tubes 16 than the opposite, windward side 30*b* of the throat extension tubes 37, as shown in FIG. 3. As shown in FIGS.3 and 4, this novel throat extension member 30 may be added to an existing cyclone furnace 10 or the cyclone furnace 10 may be so constructed so that the re-entrant throat member 20 is integral to the furnace 10.

The present invention provides a cyclonic type furnace chamber wherein the residence times of the fuel particles therein substantially increase, thus resulting in complete combustion of the particles inside the cyclone furnace chamber thereby maximizing conversion of the solid fuel to gaseous products while inside the furnace chamber. This permits the user of a cyclone type furnace to utilize and combust a wide tolerance of ash-containing fuels for satisfactory combustion within the furnace.

The utilization of a re-entrant throat extension member in accordance with the present invention provides a sufficiently high temperature inside the cyclone furnace chamber in the vicinity of the slag tap opening to maintain the viscosity of the resulting slag below that required for its flowing to and through the slag tap opening thereby maintaining proper operation of the cyclonic action of the fuels within the furnace chamber.

Thus, while I have illustrated and described the preferred embodiments of the present invention, it is to be understood that these are capable of variation and modification, and I therefore do not wish to be limited to the precise details set forth, but desire to avail myself of some changes and alterations as fall within the purview of the following claims.

I claim:

1. A cyclone furnace including in combination:

a combustion chamber of essentially a circular cross section lying in a substantially horizontal axis, said chamber having an inlet end and an outlet end and constructed with inner walls of a refractory material, a fuel inlet chamber having an inlet end and an outlet end, said outlet end of said inlet chamber opening to the inlet end of said combustion chamber, means for injecting a mixture of ash-containing fuel into the inlet end of said fuel inlet chamber whereby the mixture of fuel and air is imparted in a helical path as it enters the inlet end of said combustion chamber thus effecting a continuous helical path of travel along the circular inner wall of said combustion chamber, fluid cooling tubes positioned in the walls of said combustion chamber for effecting heat transmission of the furnace during operation thereof, as re-entrant throat extension member mounted to the outlet end of said combustion chamber and having said fluid cooling tubes positioned therein, said extension member including a frustaconical-shaped outer surface portion of an increasing diameter thereacross as it projects into said combustion chamber for deflecting and projecting the helical path of travel of the fuel-air mixture in said combustion chamber toward the inner walls of said chamber and toward the surface of the forward portion of the inner wall toward said inlet end of said combustion chamber thereby increasing the residence time of the fuel-air mixture within the furnace, and a slag outlet opening in the lower portion of said combustion chamber on the outlet end thereof between said re-entrant throat extension member and the inner wall of the combustion chamber.

2. The cyclone furnace in accordance with claim 1 further including means for injecting additional combustion air into said combustion chamber for enforcing the helical path of travel of the fuel and air mixture within the furnace chamber, said means for injection being positioned between the inlet and outlet ends of said combustion chamber along the cylindrical inner walls thereof.

3. A cyclone furnace assembly for burning ash-containing coals includes a circular cross-sectional combustion chamber aligned in a substantially horizontal axis and having an inlet end and an outlet end, the combustion chamber includes an inner wall surface thereof comprised of a refractory material covering fluid heating tubes therein for heat transmission of the furnace, the combustion chamber having a fuel inlet chamber having an inlet end and an outlet end, with the outlet end opening to the inlet end of the chamber and having means for injecting a mixture of ash-containing fuel into the fuel inlet chamber whereby the fuel and air is imparted as a helical path as it enters the inlet end of the combustion chamber and travels along the inner walls of the chamber, the combustion chamber further having a re-entrant throat element positioned in the outlet end of the chamber and a slag outlet between the re-entrant throat and the outer wall of the combustion chamber, the improvement comprising:

a re-entrant throat extension member mounted to the re-entrant throat element, said extension member having fluiding cooling tubes positioned therein with said member being of a frustaconical shape and having an outer surface which flares toward the inner wall surface of the chamber substantially toward the inlet end of the combustion chamber, said outer surface deflecting the helical path of travel of the fuel and air particles within the furnace to increase the residence time therein for complete combustion of the fuel-air mixture within the furnace.

4. In the cyclone furnace in accordance with claim 3 wherein the cyclone furnace includes injection means positioned between the inlet and outlet ends of the combustion chamber for enforcing the helical path of travel of the fuel and air mixture within the chamber and said re-entrant throat extension member is a non-symmetrical form such that the length of said resilient throat extension member is greater on the lee side of the injection means in a helical path than the length on the windward side of the injection means.

5. A cyclone furnace including in combination:

a combustion chamber of essentially a circular cross section lying in a substantially horizontal axis, said chamber having an inlet end and an outlet end and constructed with inner walls of a refractory material, a fuel inlet chamber having an inlet end and an outlet end, said outlet end of said inlet chamber opening to the inlet end of said combustion chamber, means for injecting a mixture of ash-containing fuel into the inlet end of said fuel inlet chamber whereby the mixture of fuel and air is imparted in a helical path as it enters the inlet end of said combustion chamber thus effecting a continuous helical path of travel along the circular inner wall of said combustion chamber, means for injecting additional combustion air into said combustion chamber for enforcing the helical path of travel of the fuel and air mixture within the furnace chamber, said means for injection being positioned between the inlet and outlet ends of said combustion chamber along the cylindrical inner walls thereof, fluid cooling tubes positioned in the walls of said combustion chamber for effecting heat transmission of the furnace during operation thereof, a re-entrant throat extension member mounted to the outlet end of said combustion chamber and having said fluid cooling tubes positioned therein, said extension member including a frustaconical-shaped outer surface portion which flares toward the inner walls of said chamber for projecting the helical path of the fuel-air mixture toward the surface of the forward portion of the inner wall of the combustion chamber thereby increasing the residence time of the fuel-air mixture within the furnace, with said extension member having a non-symmetrical cylindrical form such that the length of said re-entrant throat extension member is greater on the lee side of said means for injecting additional combustion air in a helical path than the length on the windward side of said means for injecting additional combustion air within the furnace, and a slag outlet opening in the lower portion of said combustion chamber on the outlet end thereof between said re-entrant throat extension and the inner wall of the combustion chamber.

* * * * *

UNITED STATES PATENT AND TRADEMARK OFFICE

CERTIFICATE OF CORRECTION

PATENT NO. : 4,473,014

DATED : September 25, 1984

INVENTOR(S) : Daniel Dejanovich

It is certified that error appears in the above—identified patent and that said Letters Patent is hereby corrected as shown below:

On the title page,

In the title, change "DETECTOR" to --DEFLECTOR--.

Signed and Sealed this

*Twelfth* Day of *March 1985*

[SEAL]

*Attest:*

DONALD J. QUIGG

*Attesting Officer* *Acting Commissioner of Patents and Trademarks*